US008448555B2

(12) United States Patent
Dow et al.

(10) Patent No.: US 8,448,555 B2
(45) Date of Patent: May 28, 2013

(54) BRAIDED LOOP UTILIZING BIFURCATION TECHNOLOGY

(75) Inventors: Richard M. Dow, Philadelphia, PA (US); Stephen J. Kryven, Langhorne, PA (US)

(73) Assignee: Triaxial Structures, Inc., Warminster, PA (US)

( * ) Notice: Subject to any disclaimer, the term of this patent is extended or adjusted under 35 U.S.C. 154(b) by 5 days.

(21) Appl. No.: 13/191,017

(22) Filed: Jul. 26, 2011

(65) Prior Publication Data

US 2012/0024134 A1 Feb. 2, 2012

Related U.S. Application Data

(60) Provisional application No. 61/368,417, filed on Jul. 28, 2010, provisional application No. 61/413,034, filed on Nov. 12, 2010.

(51) Int. Cl.
*D04C 1/06* (2006.01)

(52) U.S. Cl.
USPC ..... 87/13

(58) Field of Classification Search
USPC .. 87/5, 9, 11, 13; 57/201; 623/2.37; 132/275; D28/41
See application file for complete search history.

(56) References Cited

U.S. PATENT DOCUMENTS 330,087 A * 11/1885 Binns ..... 474/253
1,032,870 A 7/1912 Wardell
1,423,587 A 7/1922 Wardell
2,148,164 A 3/1938 Krippendorf
2,228,441 A * 1/1941 Cohen ..... 57/206
3,714,861 A 2/1973 Strangfeld
4,042,979 A * 8/1977 Angell ..... 623/2.37
4,084,479 A 4/1978 Ratera
4,275,638 A 6/1981 DeYoung
4,700,054 A 10/1987 Triplett
4,774,871 A 10/1988 Jones et al.
4,943,334 A 7/1990 Medney et al.
5,201,880 A * 4/1993 Wright et al. ..... 623/2.37
5,287,790 A 2/1994 Akiyama et al.
5,361,674 A 11/1994 Akiyama et al.
5,782,864 A 7/1998 Lizardi
5,826,593 A * 10/1998 Haubrich ..... 132/128
D443,954 S * 6/2001 Blum et al. ..... D28/41
6,360,644 B1 3/2002 Bettger
6,599,561 B2 7/2003 Dow et al.
6,907,810 B2 6/2005 Kim
6,923,824 B2 8/2005 Morgan et al.
6,942,693 B2 9/2005 Chouinard et al.
7,004,967 B2 2/2006 Chouinard et al.
7,105,019 B2 9/2006 Hojeibane
7,237,466 B2 7/2007 Chen (Continued)

*Primary Examiner* — Shaun R Hurley
(74) *Attorney, Agent, or Firm* — Duane Morris LLP; Steven E. Koffs

(57) ABSTRACT

A method, comprises providing a braid unit having a body braid section, at least two first arms at a first end of the body braid section, and at least two second arms at a second end of the body braid section. Each first arm is passed in through the second end and out through the first end of the body braid section. Each second arm is passed in through the first end and out through the second end of the body braid section. The first and second arms are pulled past each other after passing through the body braid section, so as to gather the body braid section into a ring.

16 Claims, 20 Drawing Sheets

U.S. PATENT DOCUMENTS

| | | | | |
|---|---|---|---|---|
| 7,240,475 | B2 * | 7/2007 | Smeets et al. | 57/201 |
| 7,270,043 | B2 | 9/2007 | Presz, Jr. et al. | |
| 7,399,018 | B1 | 7/2008 | Khachaturian | |
| 7,601,165 | B2 | 10/2009 | Stone | |
| 7,658,751 | B2 | 2/2010 | Stone et al. | |
| 7,908,956 | B2 | 3/2011 | Dow et al. | |
| 2002/0055313 | A1 | 5/2002 | Velpari et al. | |
| 2004/0012937 | A1 | 1/2004 | DeGrappo et al. | |
| 2006/0225564 | A1 | 10/2006 | Presz, Jr. et al. | |
| 2007/0027533 | A1 * | 2/2007 | Douk | 623/2.11 |
| 2007/0051232 | A1 | 3/2007 | Chen | |
| 2008/0216887 | A1 | 9/2008 | Hacke et al. | |
| 2009/0188380 | A1 | 7/2009 | Dow et al. | |
| 2011/0276130 | A1 * | 11/2011 | Alameddine | 623/2.37 |

* cited by examiner

BRAIDED LOOP UTILIZING BIFURCATION TECHNOLOGY

This application claims the benefit of U.S. Provisional Patent Application Nos. 61/368,417, filed Jul. 28, 2010 and 61/413,034, filed Nov. 12, 2010, both of which applications are incorporated herein in their entireties.

FIELD OF THE INVENTION

The present invention relates to a method of braiding a loop.

BACKGROUND

Continuous braided loops are used in a variety of applications, including sailing, medical, construction, and fishing to name a few. The process for creating the loop from a braid is done typically by either mechanically joining the ends together or splicing one end into the other. There are many references to splicing ropes in seamanship manuals and rope websites and the art of splices is well known to sailors and longshoremen. U.S. Pat. No. 5,782,864 to Lizardi, incorporated by reference herein in its entirety, describes creating suture loops with their ends joined by using either a suture closure or a suture needle itself, both a crimping process. U.S. Pat. No. 7,399,018 to Khachaturian, incorporated by reference herein in its entirety, describes a method for creating both wire and rope loops using both a splice and a metal over-wrap to secure the ends. These are slow processes and the ultimate strength of the loops created by these techniques is typically dependent on the joining technique.

Further U.S. Pat. No. 7,601,165 to Stone, incorporated by reference herein in its entirety, describes creating a loop by passing the ends of a braided body through apertures in the body made by forcing the braided fibers apart to create openings for the entering and exiting of the ends with the braided body.

Further U.S. Pat. No. 6,923,824 to Morgan, incorporated by reference herein in its entirety, describes creating a continuous suture loop by threading the end of a braided suture through its core at one end and out an aperture in the side of the braided body.

A method is desired for easily creating a loop having high tensile strength without disturbing the braid from which the loop is formed.

SUMMARY

In some embodiments, a method, comprises providing a braid unit having a body braid section, at least two first arms at a first end of the body braid section, and at least two second arms at a second end of the body braid section. Each first arm is passed in through the second end and out through the first end of the body braid section. Each second arm is passed in through the first end and out through the second end of the body braid section. The first and second arms are pulled after passing through the body braid section, so as to gather the body braid section into a ring.

In some embodiments, a braided loop comprises a braid unit having a body braid section bent in a ring, at least two first arms at a first end of the body braid section, and at least two second arms at a second end of the body braid section. Each first arm passes in through the second end of the body braid section and out through the first end of the body braid section. Each second arm passes in through the first end of the body braid section and out through the second end of the body braid section. The first and second arms are adjacent to each other inside the body braid section.

DETAILED DESCRIPTION

Figure 1:
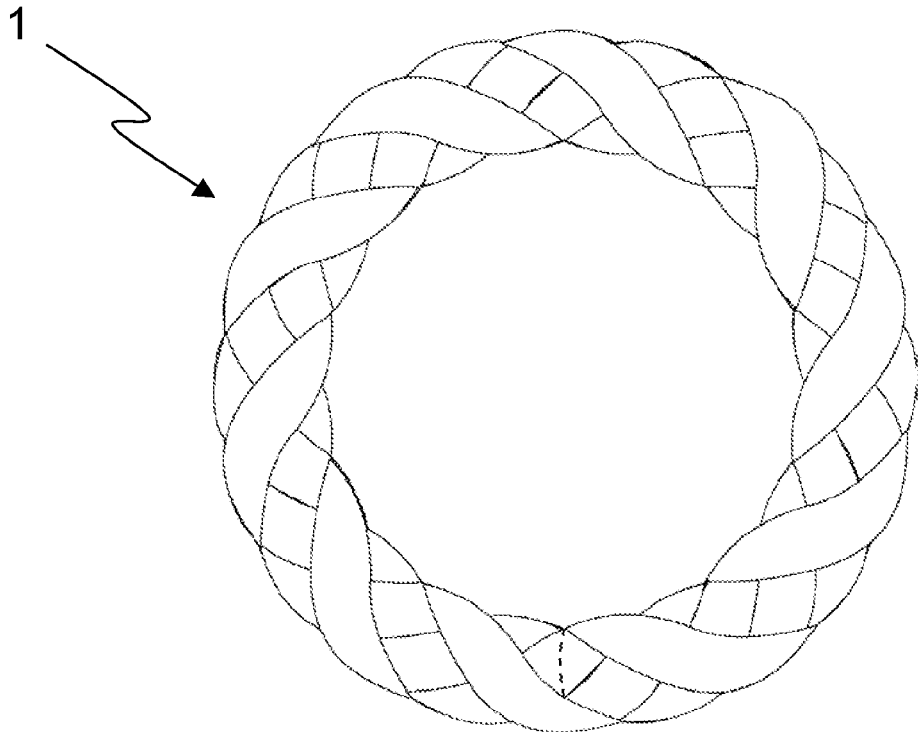
FIG. 1 is a schematic of a completed loop.

This application incorporates by reference U.S. patent application Ser. No. 12/348,601, filed Jan. 5, 2009 (now U.S. Pat. No. 7,908,956), U.S. Provisional Patent Application No. 61/019,694, filed Jan. 8, 2008, and U.S. patent application Ser. No. 13/034,053, filed Feb. 24, 2011 in their entireties.

This description of the exemplary embodiments is intended to be read in connection with the accompanying drawings, which are to be considered part of the entire written description. In the description, relative terms such as "lower", "upper", "horizontal", "vertical", "above", "below", "up", "down", "top" and "bottom" as well as derivative thereof (e.g., "horizontally", "downwardly", "upwardly", etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected" refer to a relationship wherein structures are secured or attached to one another either directly or indirectly through intervening structures, as well as both movable or rigid attachments or relationships, unless expressly described otherwise.

In some embodiments, a method creates braided loops that provide high tensile strength without using crimping, splicing or fiber displacing techniques. The method includes braiding a body braid and bifurcating the body braid into a number of bifurcation arms on either end of the body braid. The bifurcated body braid may be of one of the types described in U.S. Patent Application Publication No. 2009/0188380, including continuously woven alternating sections of round (tubular) braid and flat braids (arms). Then, by using the openings to the core of the body braid, formed by the bifurcation process itself, from opposite ends of the body braid the arms are passed through the core of the body braid and the bifurcation arms are pulled, so that the body braid forms a loop. Under tension, the body braid collapses around the inserted bifurcation arms, gripping them and not allowing them to slip, thus creating structurally sound braided loops.

In another embodiment a body braid of any number of fibers is created by typical braiding techniques known to those skilled in the art of braiding. At a point in the braid, braiding is stopped, the body braid is pulled creating a number of straight fibers. By dividing the straight fibers into 2 or more groups an opening to the core of the body braid is created. These groups can then be passed through the core of the body braid and pulled creating the loop.

In a further embodiment, the body can be created by weaving techniques. At a designated point in the weaving, the woven body tube can be split into layers of woven fabric and at another designated point, the layers can be recombined into a body tube similar to the body braid. These woven layers are then similar to the bifurcation arms and can be threaded through the body tube, pulled and thus create the loop.

Further areas of applicability will become apparent from the description. It should be understood that the description and specific examples are intended for the purpose of illustration only and are not intended to limit the scope of the present disclosure.

A structure and application of materials is disclosed herein, using braiding technology that can bifurcate from a base construction into more than one braid construction (bifurcation) and recombining at least two bifurcation constructions into one base construction. The bifurcation arm constructions are singulated and then passed through the base construction at opposite ends and pulled to form a loop. The following explanation describes the assembly of one loop using four bifurcation arms, however the technique is not limited to four arms and can be, by extension, used for creating loops of any number of bifurcation arms.

Figure 15:
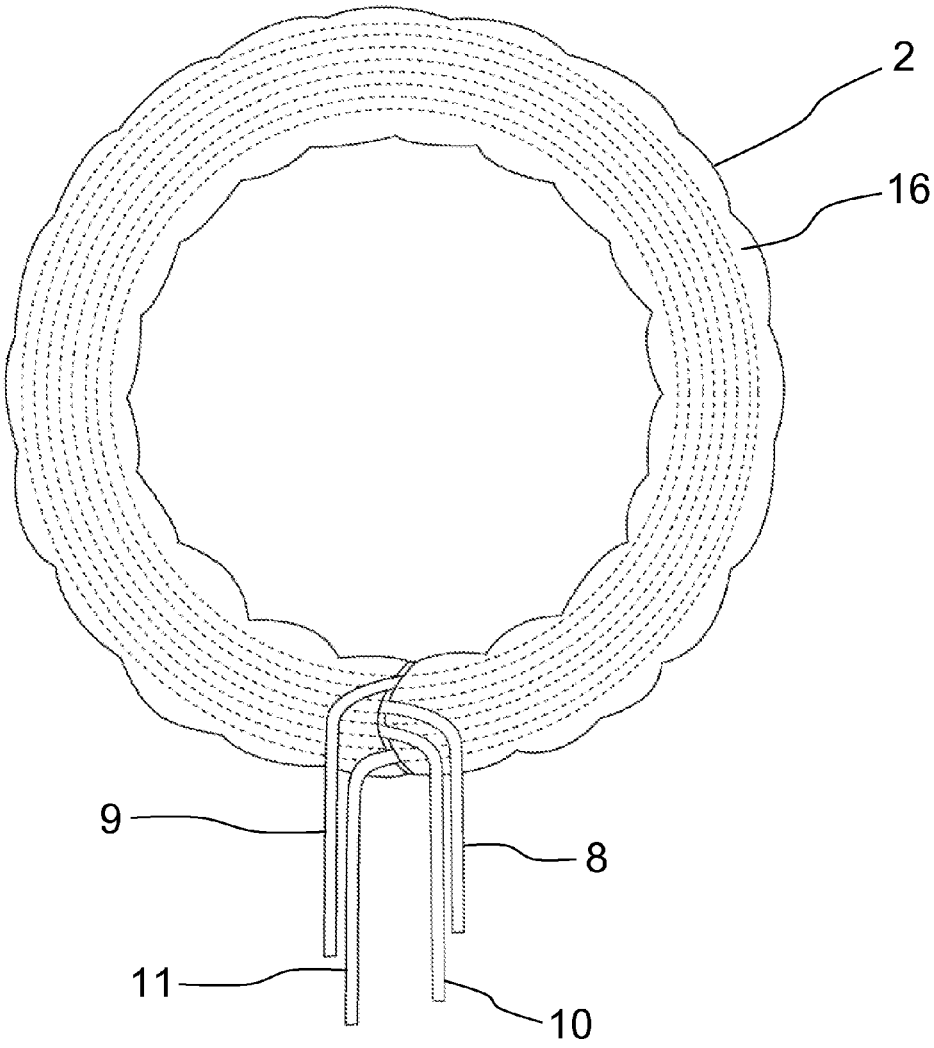
FIG. 15 is a schematic diagram of the completed loop.
Figure 16:
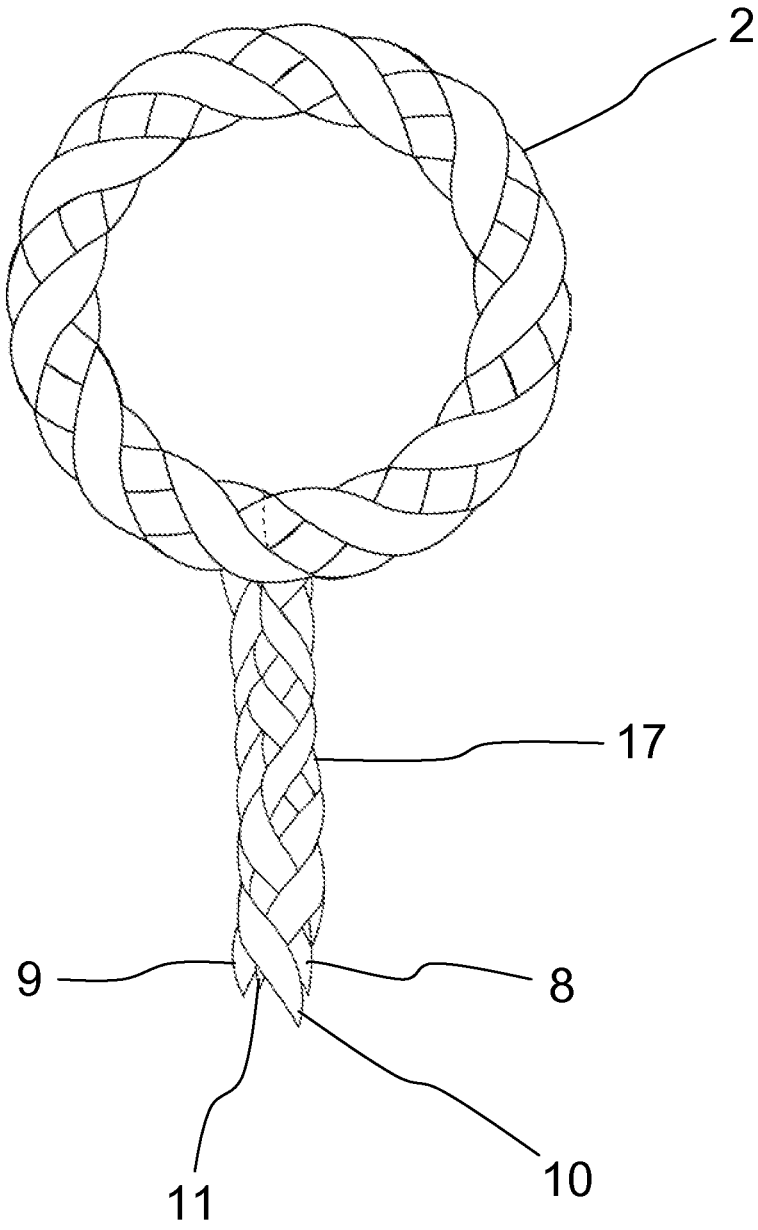
FIG. 16 is a schematic diagram of a loop with an integrated braided tail.
Figure 19:
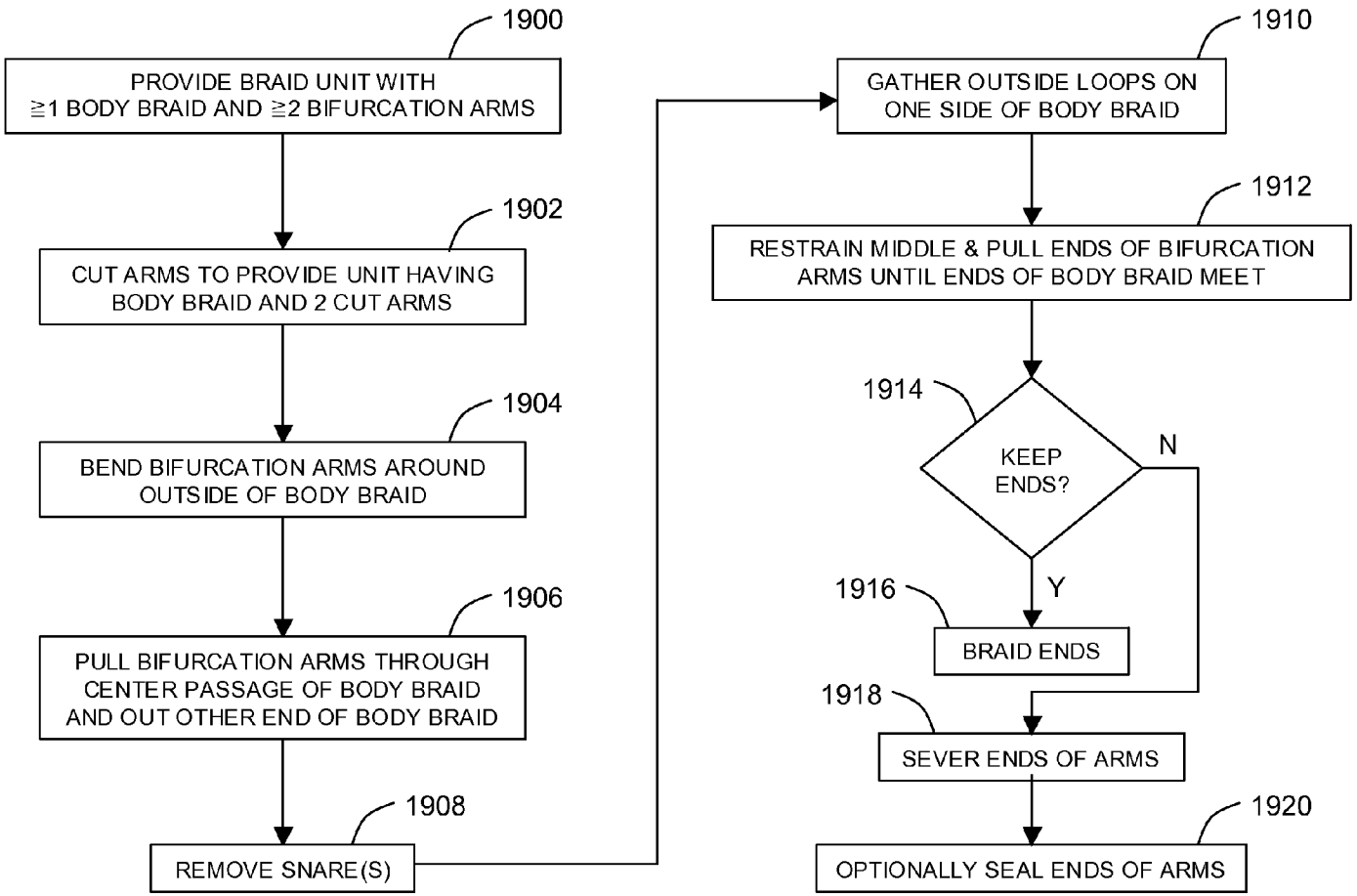
FIG. 19 is a flow chart of a method for making the loop.
Figure 20:
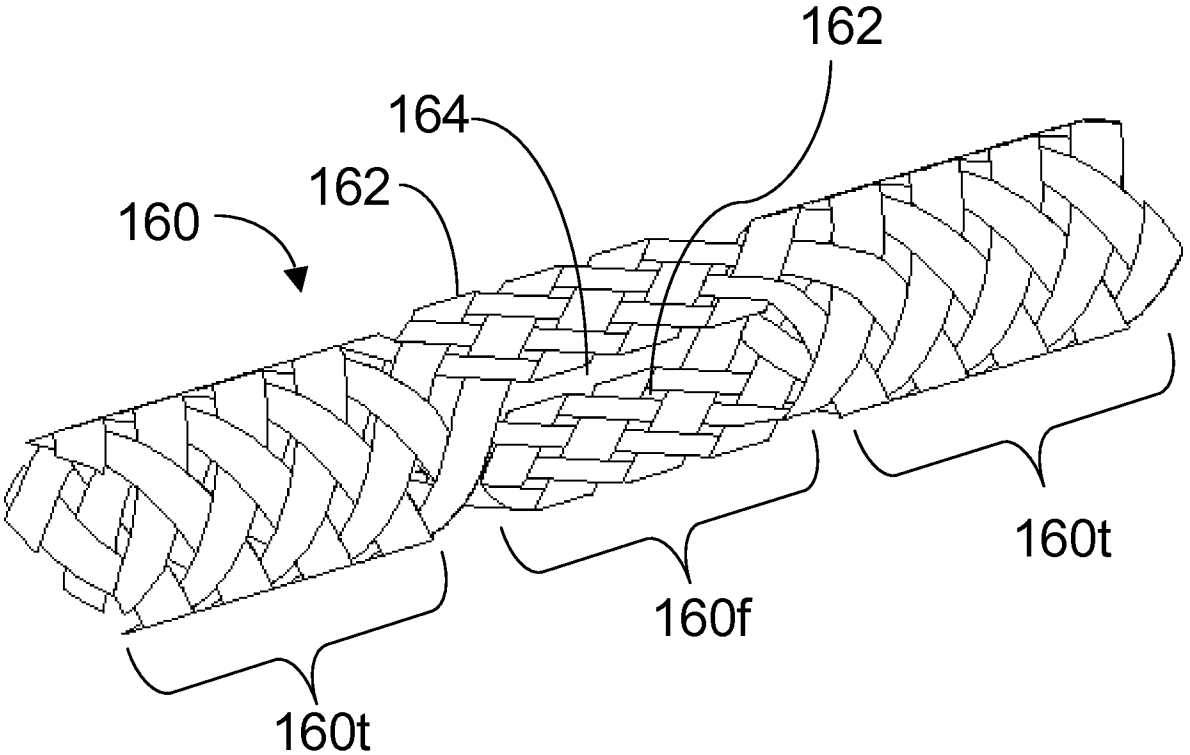
FIG. 20 is a detailed diagram of a bifurcated braid.

FIG. 1 shows a completed loop (1) and will be referred to in the following descriptions. FIG. 19 is a flow chart of a method of making the loop (1). FIGS. 2-18 show the loop during various stages of its formation. In FIGS. 2-18, each bifurcation arm (8), (9), (10), (11) is shown as a unitary arm for ease of viewing. However, it will be understood that each bifurcation arm (8), (9), (10), (11) is a flat braid section having plural fibers or yarns, as shown in FIG. 16 of U.S. patent application Ser. No. 12/348,601 (now U.S. Pat. No. 7,908,956), which is included herein as FIG. 20 of this application. In FIG. 20, a braid unit 160 is shown, having alternating body braid and bifurcation arm sections. The body braid sections are tubular braid sections (160*t*), and the bifurcation arm sections (160*f*) are flat braids 162 separated by a slot 164.

Figure 2:
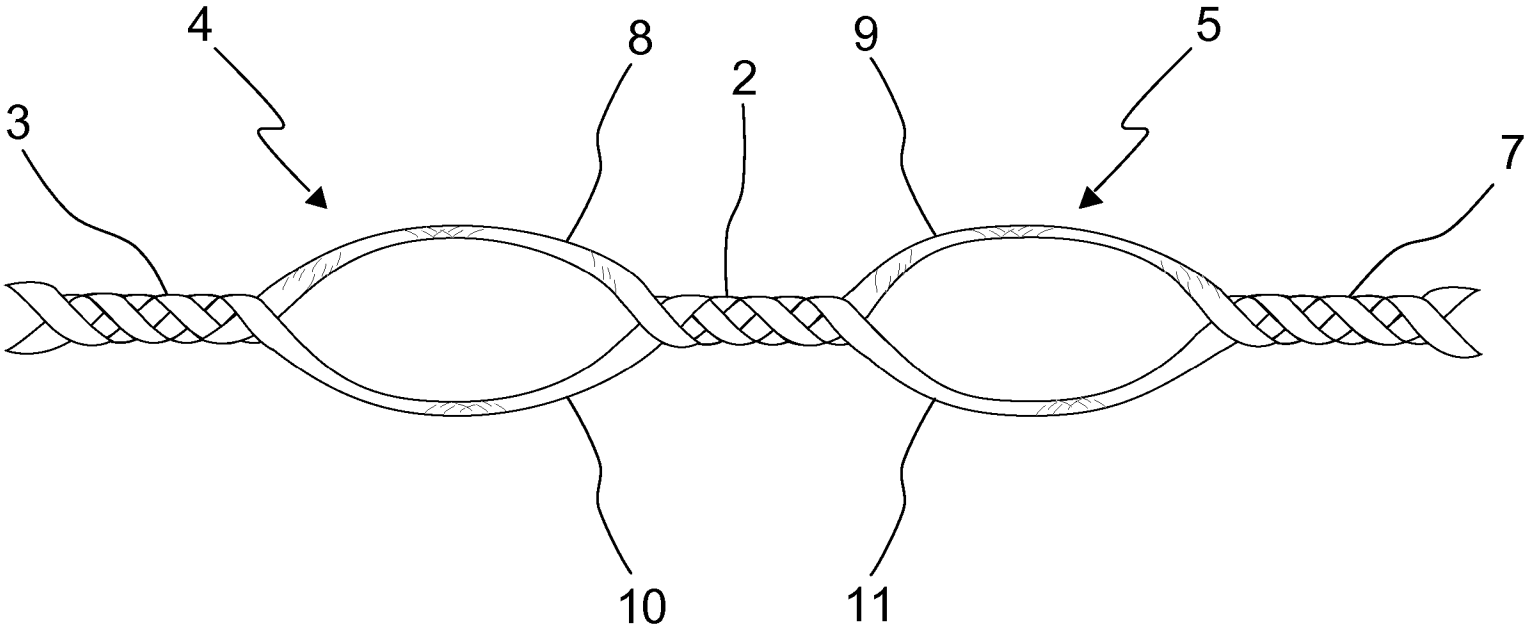
FIG. 2 is a schematic diagram of a string of body braids separated by bifurcations.

At step 1900 of FIG. 19, a bifurcated braid is provided having at least one body braid section and at least two bifurcation arms at the ends of the body braid. FIG. 2 shows a schematic of a string of bifurcations (4), (5) and body braids (2), (3), (7). The arms (4), (5) schematically represent the bifurcation arms (162) of FIG. 20. These strings can be comprised of any material capable of being braided. In structural applications, the materials may be high modulus such as Kevlar® aramid composition sold by Dupont Corp., Wilmington, Del., or Spectra® ultra-high molecular weight polyethylene from Honeywell, Colonial Heights, Va. In medical applications the high modulus fibers or lower modulus such as polyester could be used.

Figure 3:
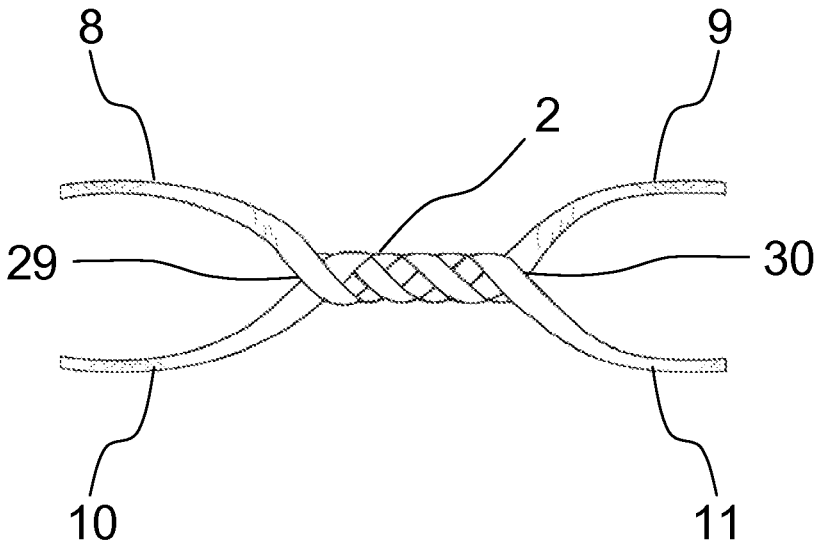
FIG. 3 is a schematic diagram of a singulated loop device with 4 bifurcation arms.

Typically these fibers or yarns are braided in a continuous string of body braids (2), (3), (7), and bifurcations (4), (5), however as few as two bifurcations (4), (5) separated by one body braid (2) may be used. Each bifurcation (4), (5) has two or more bifurcation arms (8), (9). Each arm (4), (5) comprises two or more fibers or yarns in a flat braid section, as shown in FIG. 20. For example, each arm (4), (5) may have four fibers or yarns. The length of the pair of bifurcation arms (4), (5) is at least 2 times the length of the body braid (2). The bifurcation arms (8), (9), (10), (11) are cut typically halfway from one body braid (2) to the next body braid (3), but halfway is not a requirement, so long as the cut portions of the bifurcation arms (8), (9), (10), (11) are longer than the length of the body braid (2) after cutting, preferably more than twice the length of the body braid (2). This separates a single device from the string, as shown in FIG. 3.

Each arm (8), (9), (10), (11) has a proximal end which meets the body braid section (2), and a distal end opposite the proximal end. The braid unit of FIG. 3 is a plurality of continuous fibers or yarns, extending without break from a distal end of the first arms across the body braid section to a distal end of the second arms.

For example, in one embodiment, the body braid section (2) is braided with eight fibers. Each arm (8), (9), (10), (11) has four fibers or yarns, and the entire braid unit is formed of only eight continuous fibers or yarns, extending without break from a distal end of the first arms (8), (10) across the body braid section to a distal end of the second arms (9), (11).

At step 1902 of FIG. 19, the arms (4), (5) are cut to provide at least one unit having a body braid (2) and singulated bifurcation arms (8), (9), (10), (11). FIG. 3 shows a singulated device having four bifurcation arms (8), (9), (10), (11) separated by a body braid (2). In some embodiments, the length of the body braid (2) is the length of the circumference of the loop (1) and the length of the bifurcation arms (8), (9), (10), (11) are, at a minimum, the length of the circumference of the loop (1). In other embodiments, the length of the bifurcation arms (8), (9), (10), (11) are an integer multiple of the length of the circumference of the loop (1) plus a small additional length sufficient to be grasped by a hand of a person, or by a tool or machine for performing the steps discussed below with reference to FIGS. 5-13.

Figure 4:
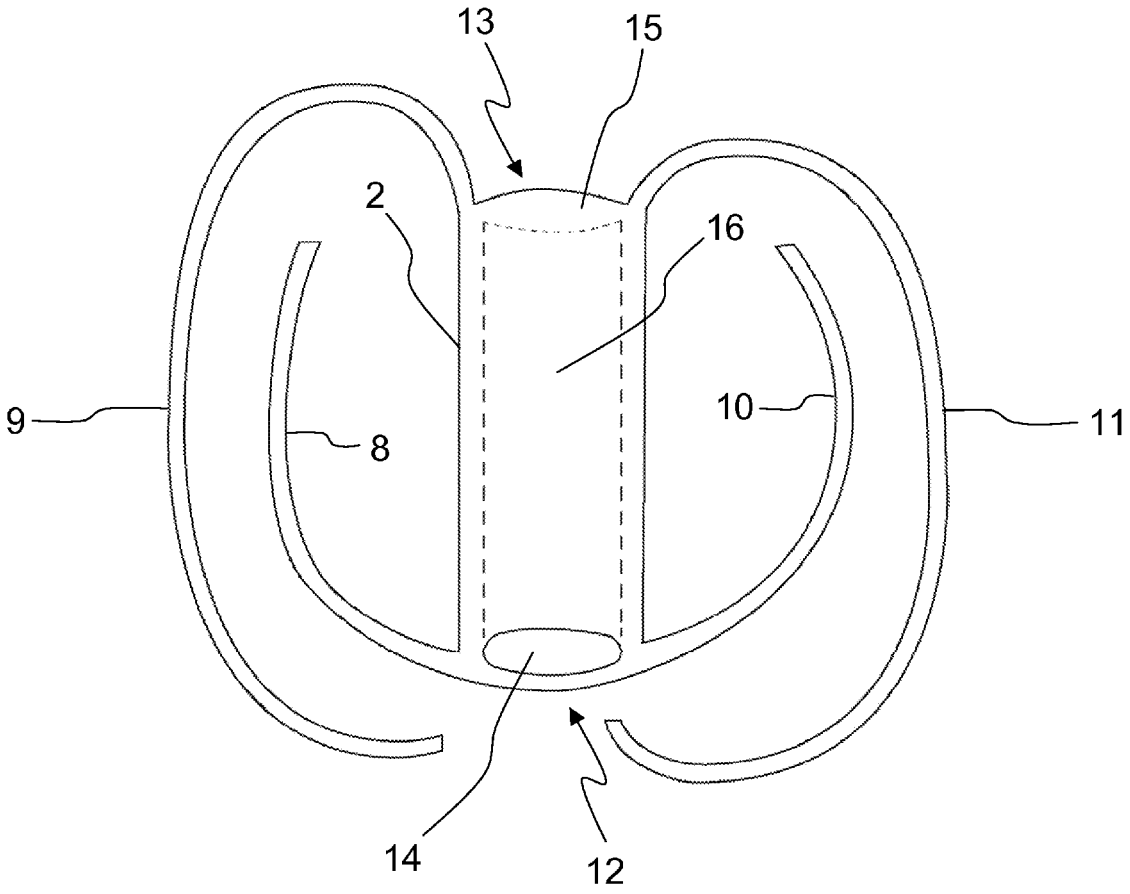
FIG. 4 is a schematic diagram of the ends in position to be passed through the body braid.

At step 1904 of FIG. 19, the ends of the bifurcation arms (8), (9), (10), (11) are bent from one end of the body braid (2) to the other as shown in FIG. 4. For example, bifurcation arm (8) originates at the end (12) of body braid (2) and is bent to the opposite end (13) of body braid (2). Bifurcation arm (9) originates at the end (13) of body braid (2) and is bent to the opposite end (12) of body braid (2). Bifurcation arm (10) originates at the end (12) of body braid (2) and is bent to the opposite end (13) of body braid (2). Bifurcation arm (11) originates at the end (13) of body braid (2) and is bent to the opposite end (12) of body braid (2). Because of bifurcation, spreading the bifurcation arms, for instance (8), (10), allows access to the body braid inner core passageway (16) through body braid inner core passageway opening (14). The bending of the bifurcation arms aligns the bifurcation arms (9), (11) with the body braid inner core passageway opening (14) and bifurcation arms (8), (10) with the body braid inner core passageway opening (15), hidden.

Figure 5:
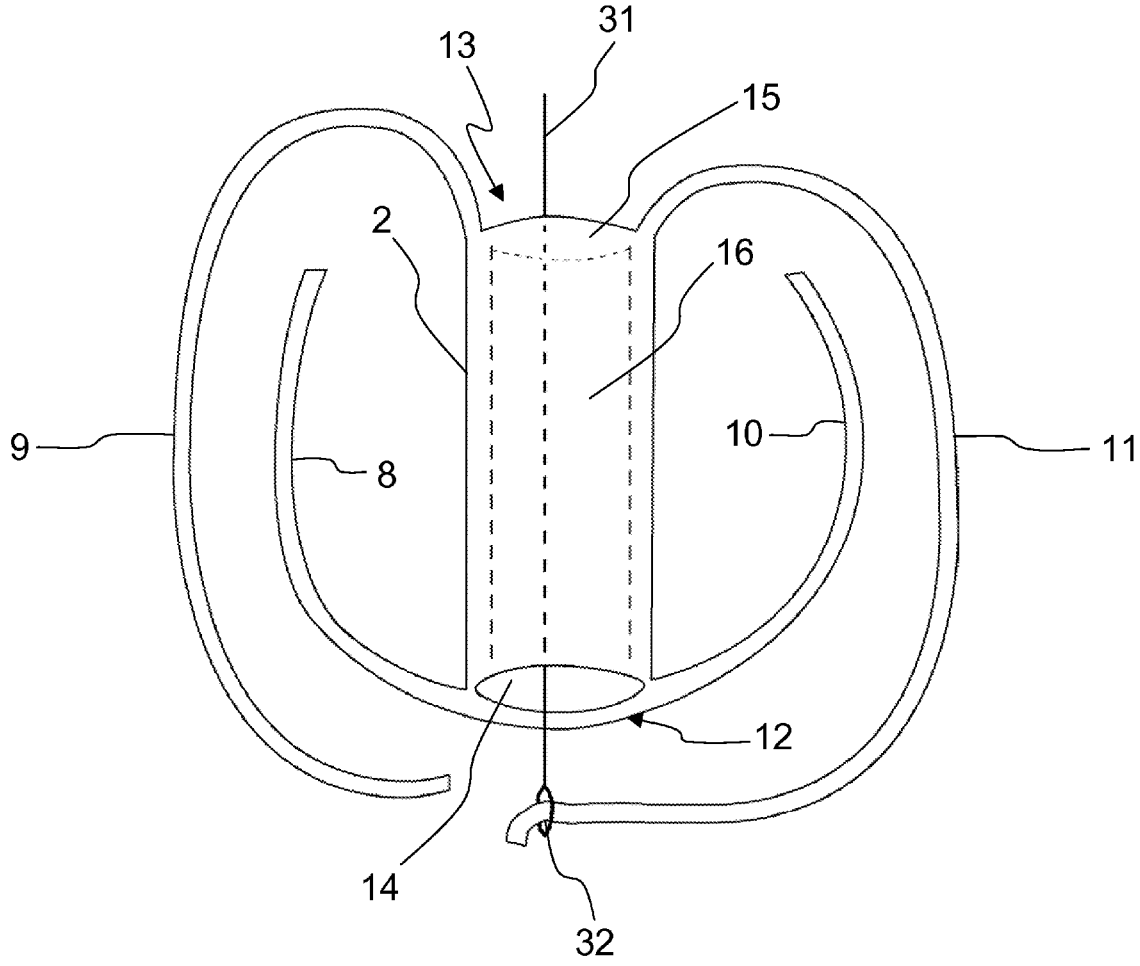
FIG. 5 is a schematic diagram of an end ready to be pulled through the body braid using a snare.
Figure 6:
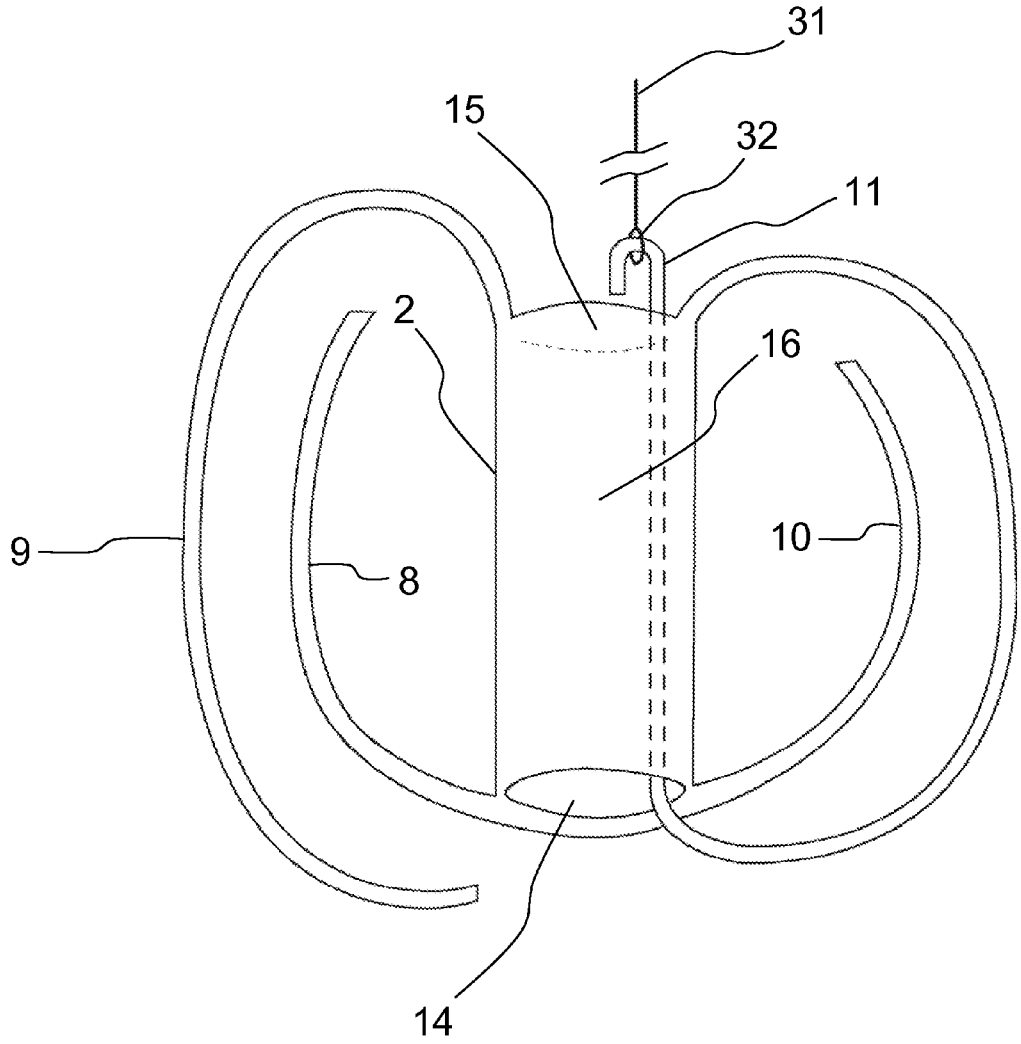
FIG. 6 is a schematic diagram of an end pulled through the body braid using a snare.

At step 1906 of FIG. 19, the bifurcation arms (8), (9), (10), (11) are then pulled through the openings (14), (15) of the body braid (2). FIG. 5, shows one embodiment of a method for pulling a bifurcation arm (11) through the body braid inner core passageway (16). A snare (31) is passed through the body braid inner core passageway (16) and the bifurcation arm (11) is threaded through the opening (32) in the snare. FIG. 6 shows the snare (31) pulled through the body braid inner core passageway (16) pulling the bifurcation arm (11) with it. A snare is passed through the body braid inner core passageway for each bifurcation arm. Although FIG. 6 shows the arm (11) being pulled by the snares 31, in other embodiments, a rigid snare is inserted from the opposite end of the body braid (2), and the rigid snare is pushed to draw the arm 11 through the body braid inner core passageway (16). For example, with the body braid (2) oriented as shown in FIG. 6, instead of pulling the snare 31 up from the top, the snare 31 may be pushed from the bottom of the body braid (2).

Figure 7:
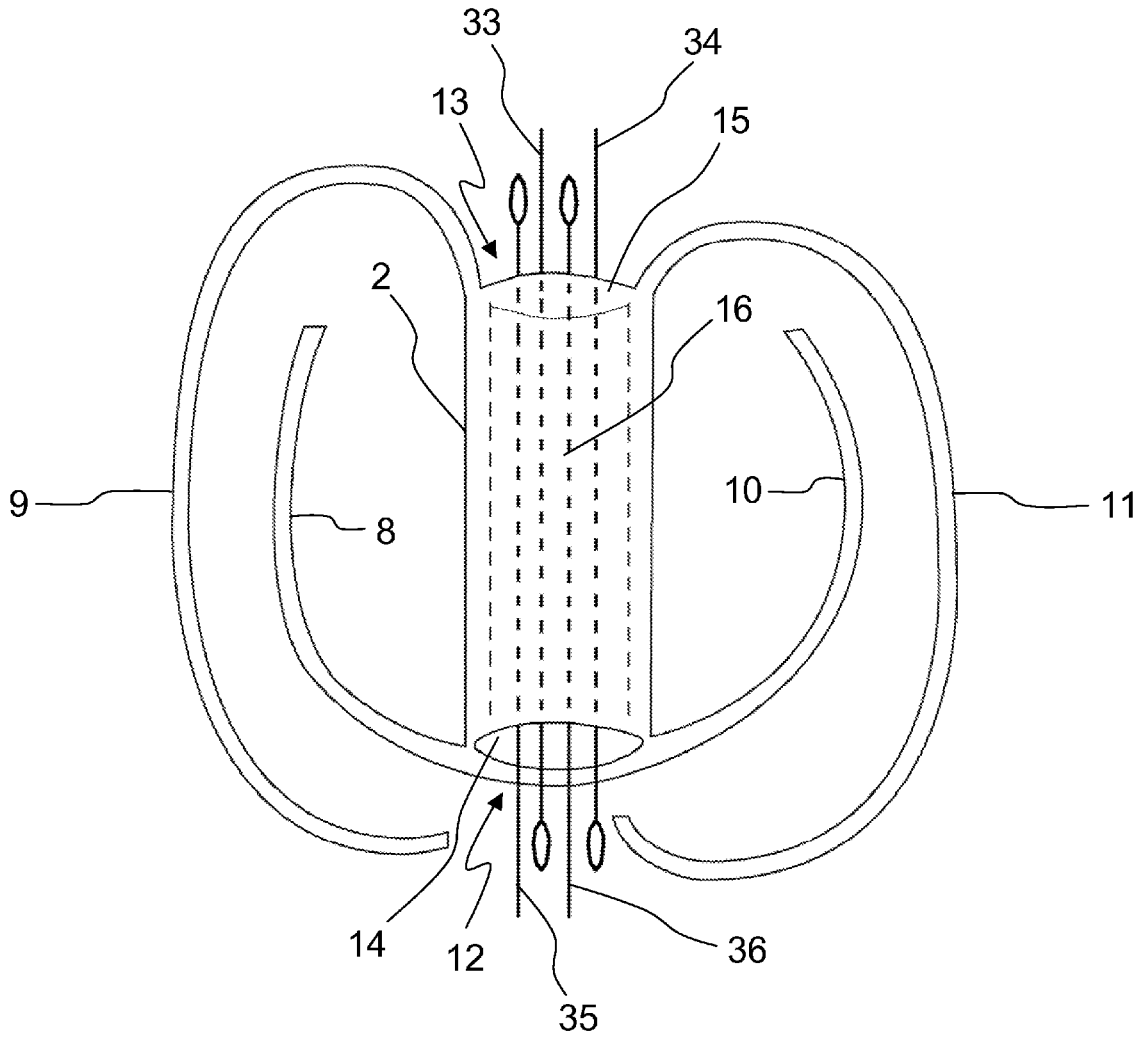
FIG. 7 is a schematic diagram of all ends ready to be pulled through the body braid using pre-installed snares.

At step 1908 of FIG. 19, the snare(s) is (are) removed by pulling the snare and its corresponding arm (11) through the body braid inner core passageway (16). In some embodiments, one single snare (31) is used for all the arms (8), (9), (10), (11). In some embodiments, two snares (31) are used, one for each end of the body braid. In some embodiments, a respectively different snare (31) is used for each respective arm (8), (9), (10), (11), as shown in FIG. 7. After pulling all the arms (8), (9), (10), (11) through the body braid (2), the result is as described below and shown in FIG. 11.

In an embodiment shown in FIG. 7, while the body braid is braided from its constituent fibers or yarns, it is braided around the snares. This can be accomplished by inserting snares (33), (34), (35), (36) into the braid at the beginning of a body braid (12). When the body braid starts, the braid is formed around the snares and creating the body braid inner core passageway opening (14). When the body braid ends and bifurcation starts (13), the body braid inner core passageway opening (15) is created, freeing the snares. Once the material is taken off the braider, the snares are in place ready to pull bifurcation arms from one end (12) of the body braid to the opposite end (13).

Figure 8:
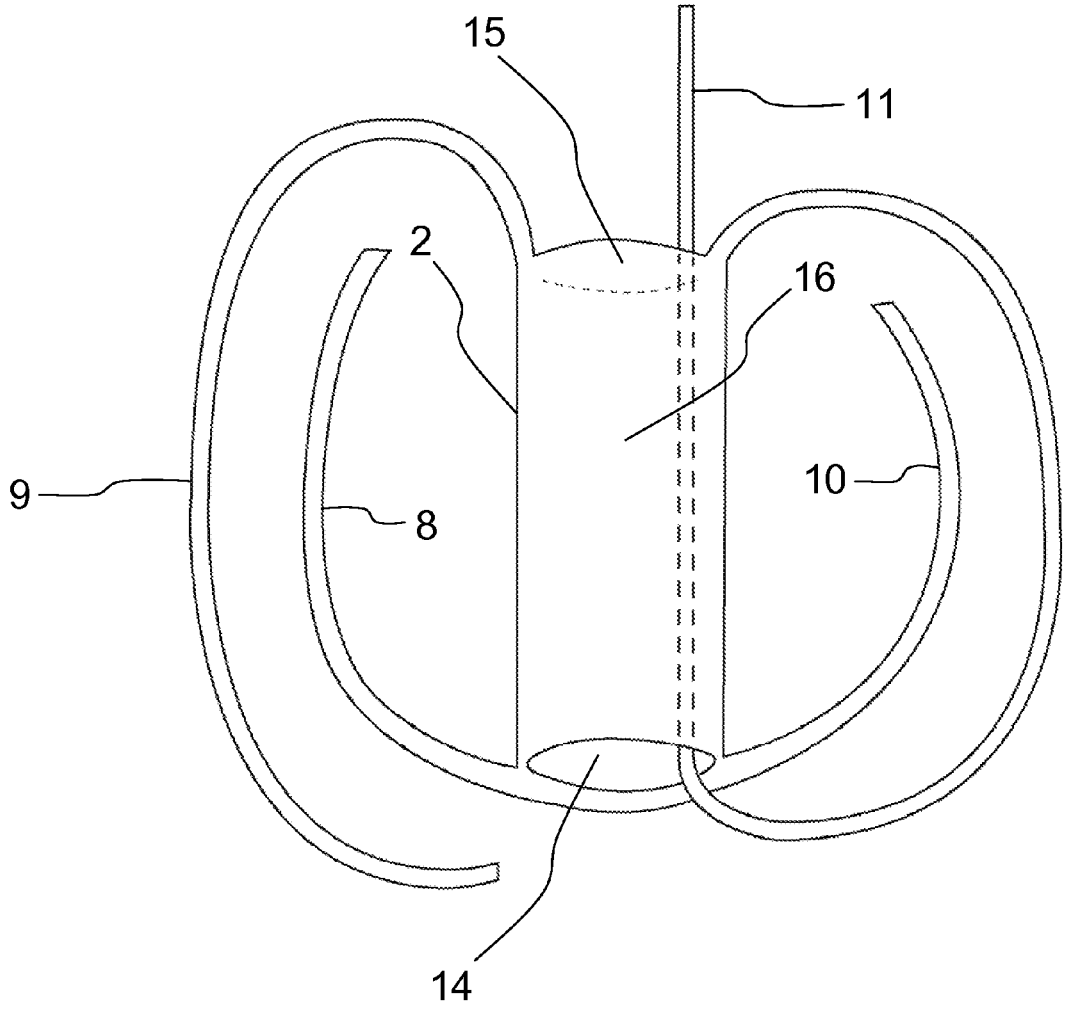
FIG. 8 is a schematic diagram of the first end passed through the body braid.

FIG. 8 shows bifurcation arm (11) entering body braid inner core passageway (16) through body braid inner core passageway opening (14), passing through body braid inner core passageway (16) and exiting through body braid inner core passageway opening (15), hidden.

Figure 9:
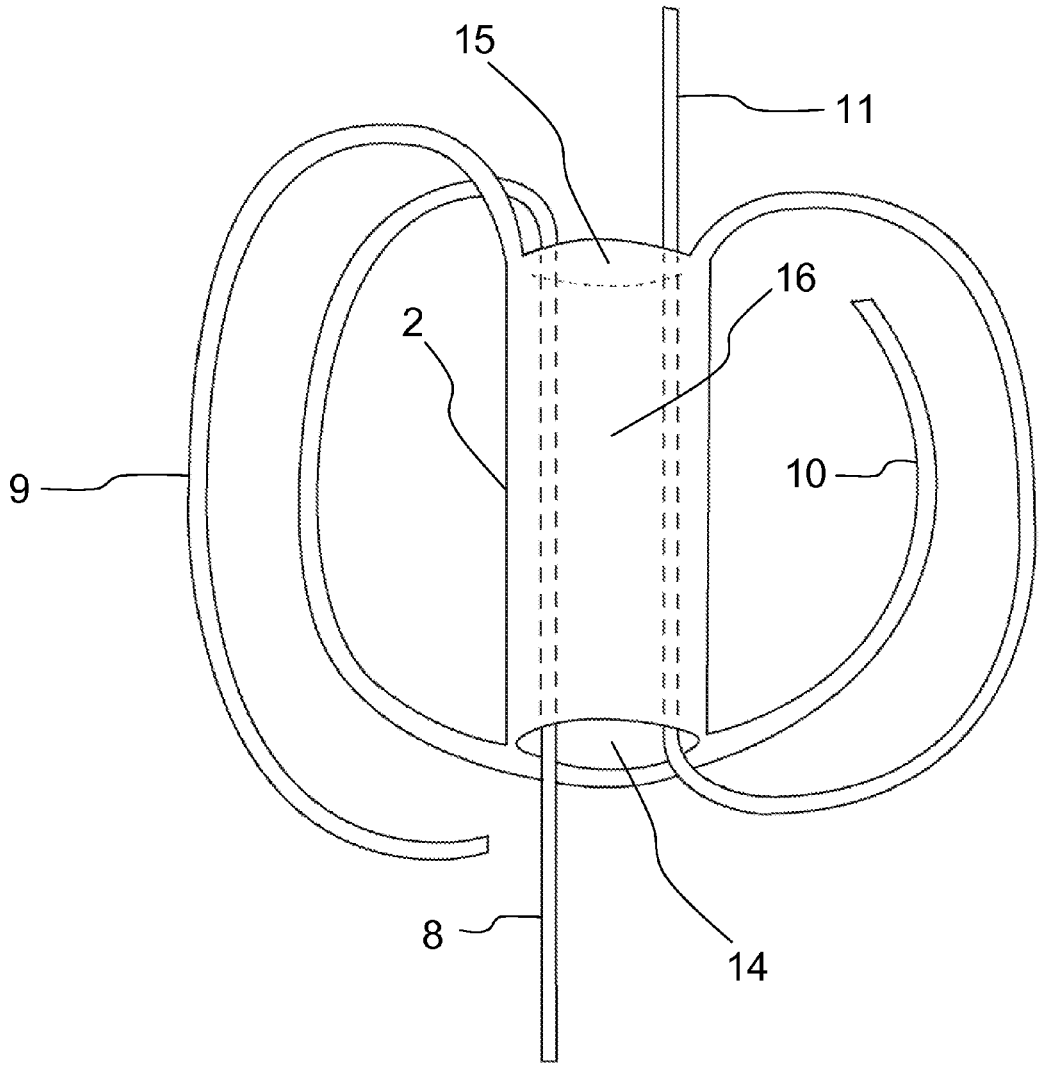
FIG. 9 is a schematic diagram of the second end passed through the body braid.

FIG. 9 shows bifurcation arm (8) entering body braid inner core passageway (16) through body braid inner core passageway opening (15), passing through body braid inner core passageway (16) and exiting through body braid inner core passageway opening (14).

Figure 10:
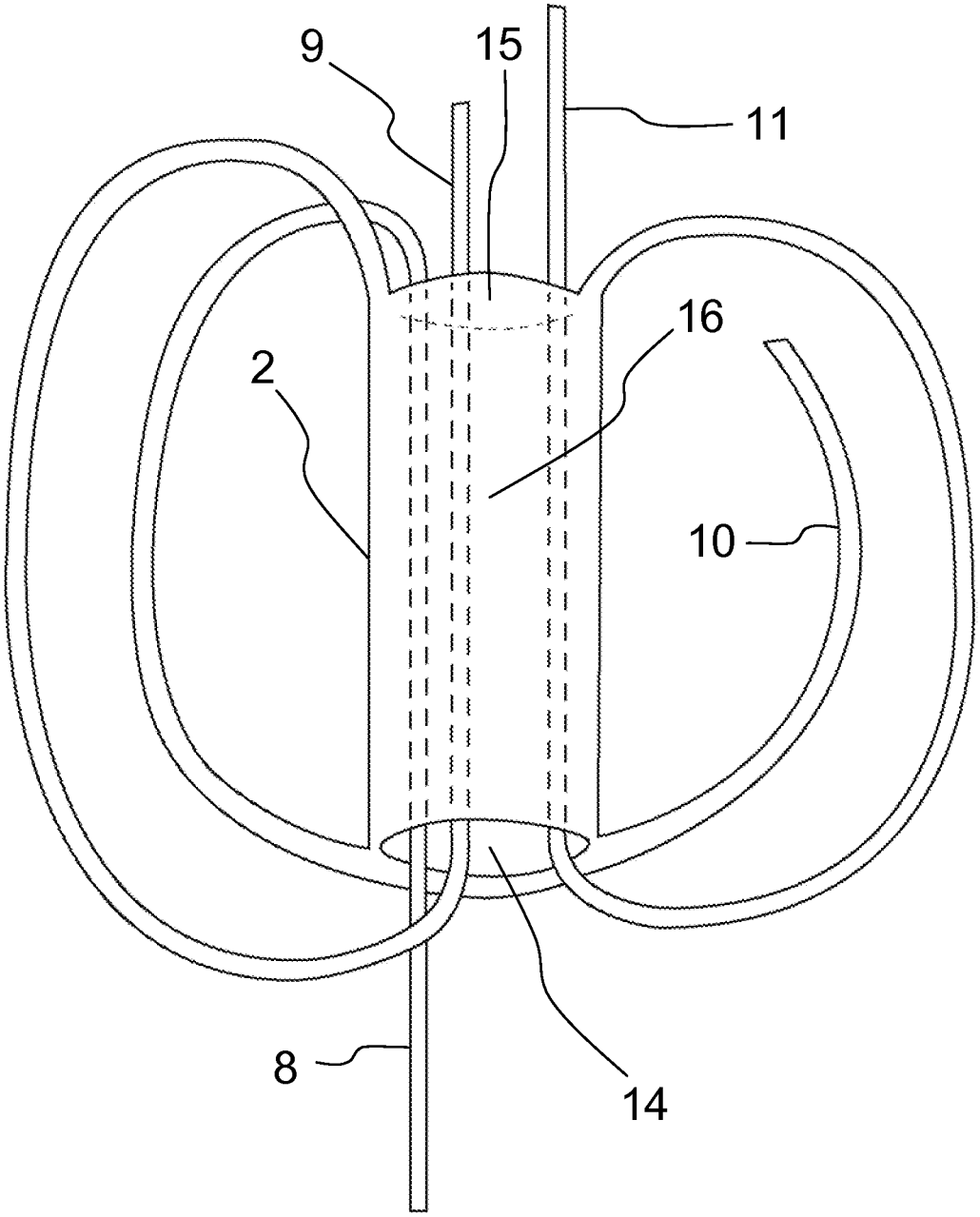
FIG. 10 is a schematic diagram of the third end passed through the body braid.

FIG. 10 shows bifurcation arm (9) entering body braid inner core passageway (16) through body braid inner core passageway opening (14), passing through body braid inner core passageway (16) and exiting through body braid inner core passageway opening (15).

Figure 11:
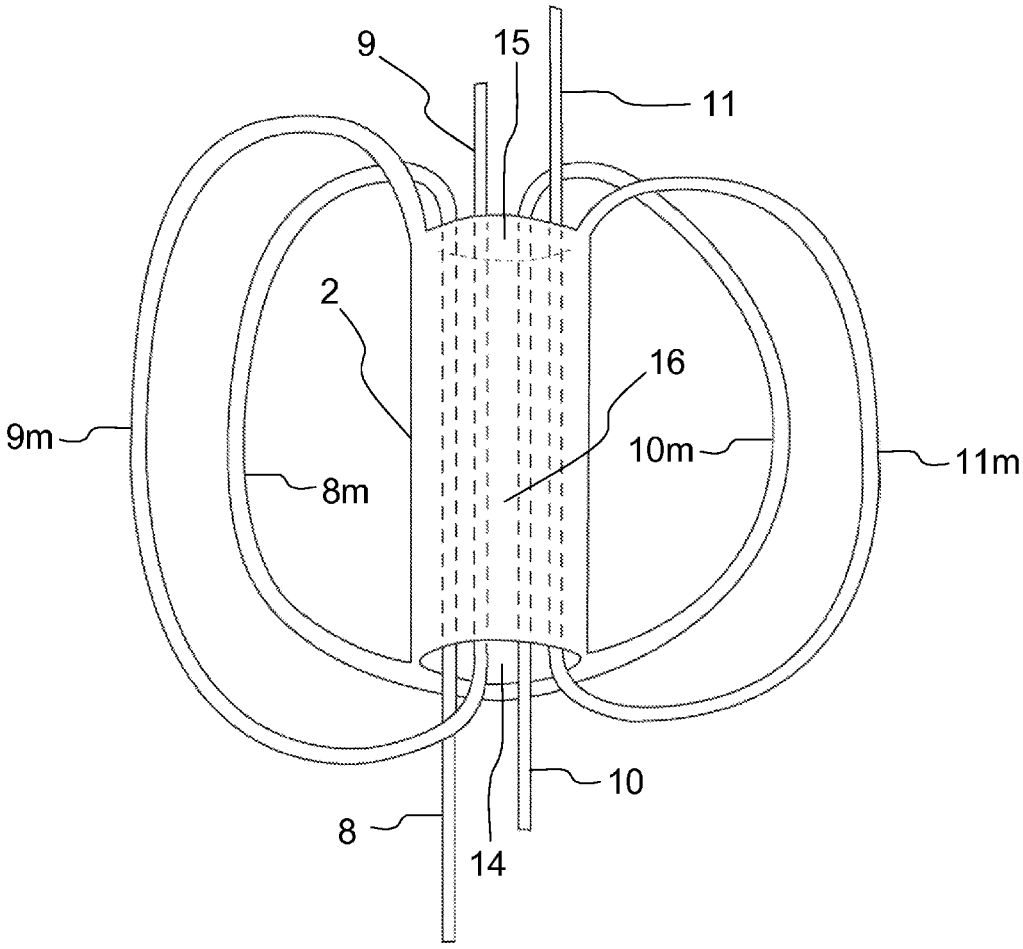
FIG. 11 is a schematic diagram of the fourth end passed through the body braid.

This is repeated for each bifurcation arm, until all of the bifurcation arms are pulled through the body braid inner core passageway (16) and extend out the opposite side. FIG. 11 shows bifurcation arm (10) entering body braid inner core passageway (16) through body braid inner core passageway opening (15), passing through body braid inner core passageway (16) and exiting through body braid inner core passageway opening (14), with the loops identified as (8*m*), (9*m*), (10*m*), (11*m*). As shown in FIG. 11, each bifurcation arm is looped at least once through body braid inner core passageway (16). If the length of the bifurcation arms is a greater multiple of (e.g., four times) the length of the body braid (2), then each bifurcation arm is looped more than one time through the body braid inner core passageway (16).

Figure 12:
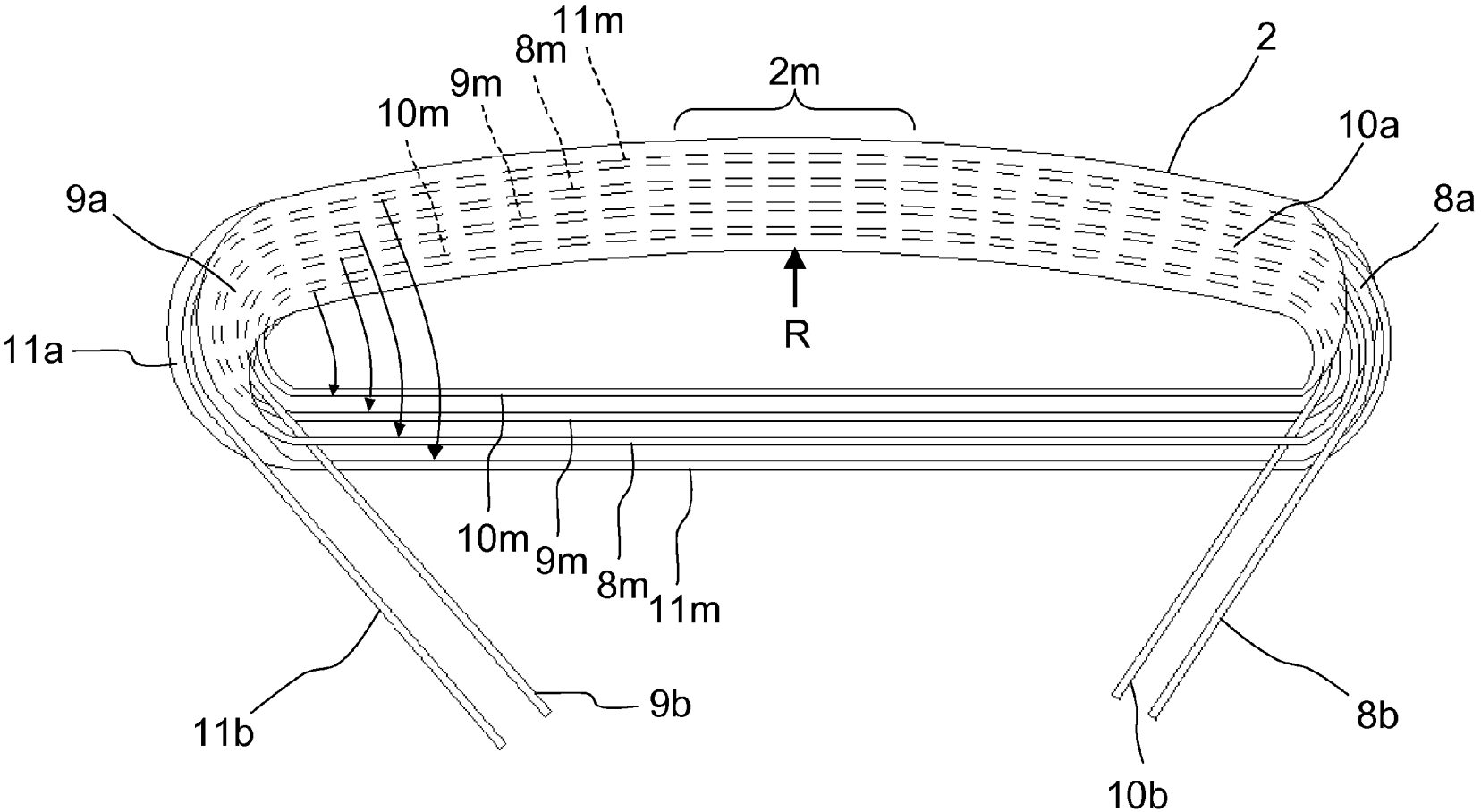
FIG. 12 is a schematic diagram of the beginning formation of the loop

At step 1910 of FIG. 19, the portions of the loops outside of the body braid are gathered on one side of the body braid as shown in FIG. 12. By gathering the loops (8*m*), (9*m*), (10*m*), (11*m*) of the bifurcation arms (8), (9), (10), (11) to one side of the body braid and starting a bend in the body braid (2), the loop can be formed, with a more detailed description below. The bend in the body braid section is initiated by restraining a middle portion 2*m* of the body braid while pulling the ends (8*b*), (9*b*), (10*b*), (11*b*) of the first and second arms (8), (9), (10), (11). (The middle portion 2*m* that is restrained may optionally be offset slightly from the center of the body braid). FIG. 12 shows the portions of the gathered loops (8*m*), (9*m*), (10*m*), (11*m*) inside the body braid inner core passageway (16) in phantom. The portions of the loops outside of the body braid inner core passageway (16) are all arranged on one side, outside of the body braid (2). A restraining force R is applied to hold the middle portion 2*m* in place while the ends (8*b*), (9*b*), (10*b*), (11*b*) are pulled.

Figure 13:
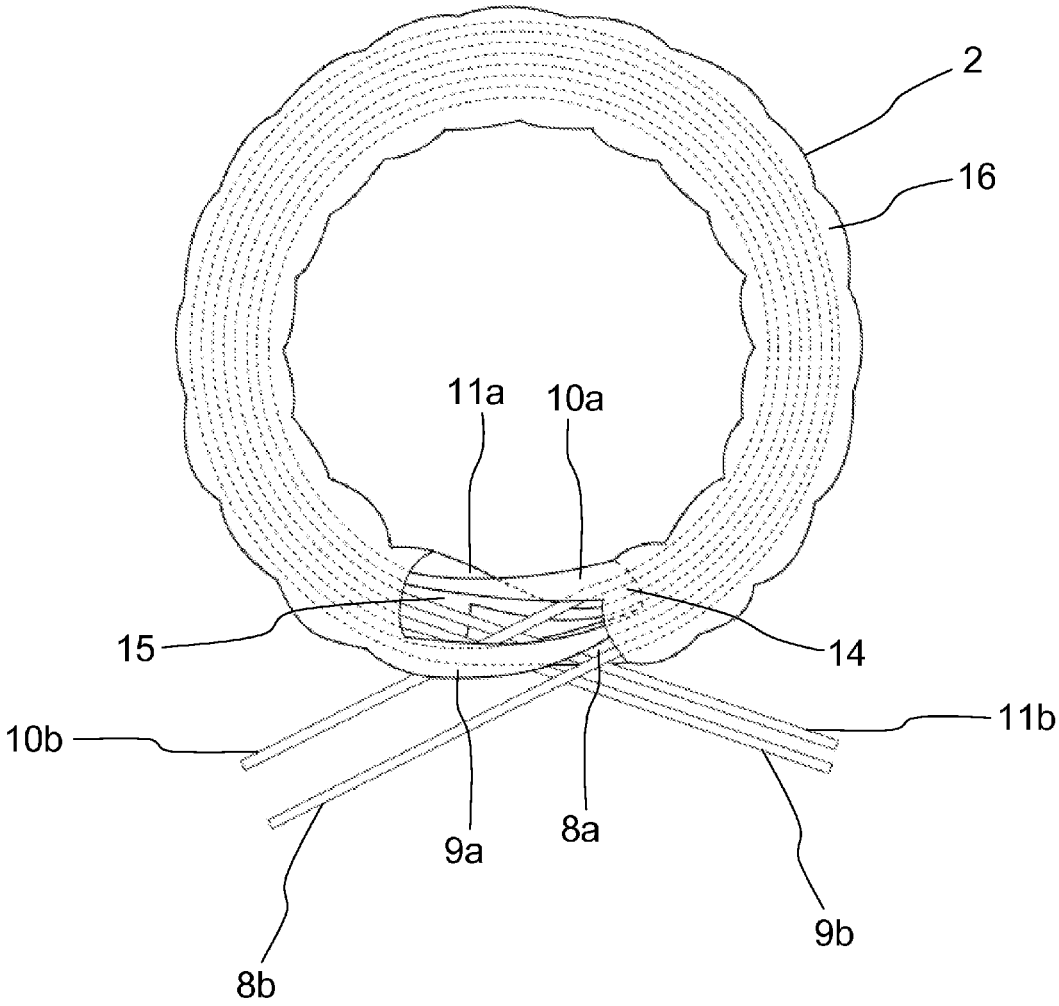
FIG. 13 is a schematic diagram of the loop being formed.

At step 1912 of FIG. 19, the ends of the bifurcation arms (8*b*), (9*b*), (10*b*), (11*b*) are pulled, until the ends of the body braid (2) meet. The arms may be pulled past each other in substantially opposite directions, as shown in FIG. 13, or the arms may both be pulled away from a center of the body braid, substantially in the downward direction. As shown in FIG. 12, when the ends of arms (8), (9), (10), (11) are pulled, the ends of the body braid (2) curl inward towards the loops (8*m*), (9*m*), (10*m*), (11*m*) so that the body braid (2) begins to form a ring, and the external portion of loops (8*m*), (9*m*), (10*m*), (11*m*) (which connect the ends of the body braid) move to the position shown in solid lines.

As shown in FIG. 13, the bifurcation arms (9*a*), (11*a*) enter the body braid inner core passageway (16), go around the body braid inner core passageway (16) and exit (9*b*), (11*b*) at body braid inner core passageway opening (15). Bifurcation arms (8*a*), (10*a*) enter the body braid inner core passageway (16), go around the body braid inner core passageway (16) and exit (8*b*), (10*b*) at body braid inner core passageway opening (14). By pulling bifurcation arm ends (9*b*), (11*b*) in one direction and (8*b*), (10*b*) in the opposite direction the bifurcation arms slide inside the body braid inner core passageway (16) and pull the body braid (2) ends into a loop shape. If the bifurcation arms are pulled far enough the ends of the body braid meet. They cannot go past each other as the crotch (29) FIG. 3 formed by the bifurcation arms at one end locks with the crotch (30) FIG. 3 at the opposite end. Referring to FIG. 15, the minimum loop diameter is determined by the length of the body braid (2), i.e., $$\text{minimum loop diameter} = \text{body braid length}/\pi.$$

Figure 14:
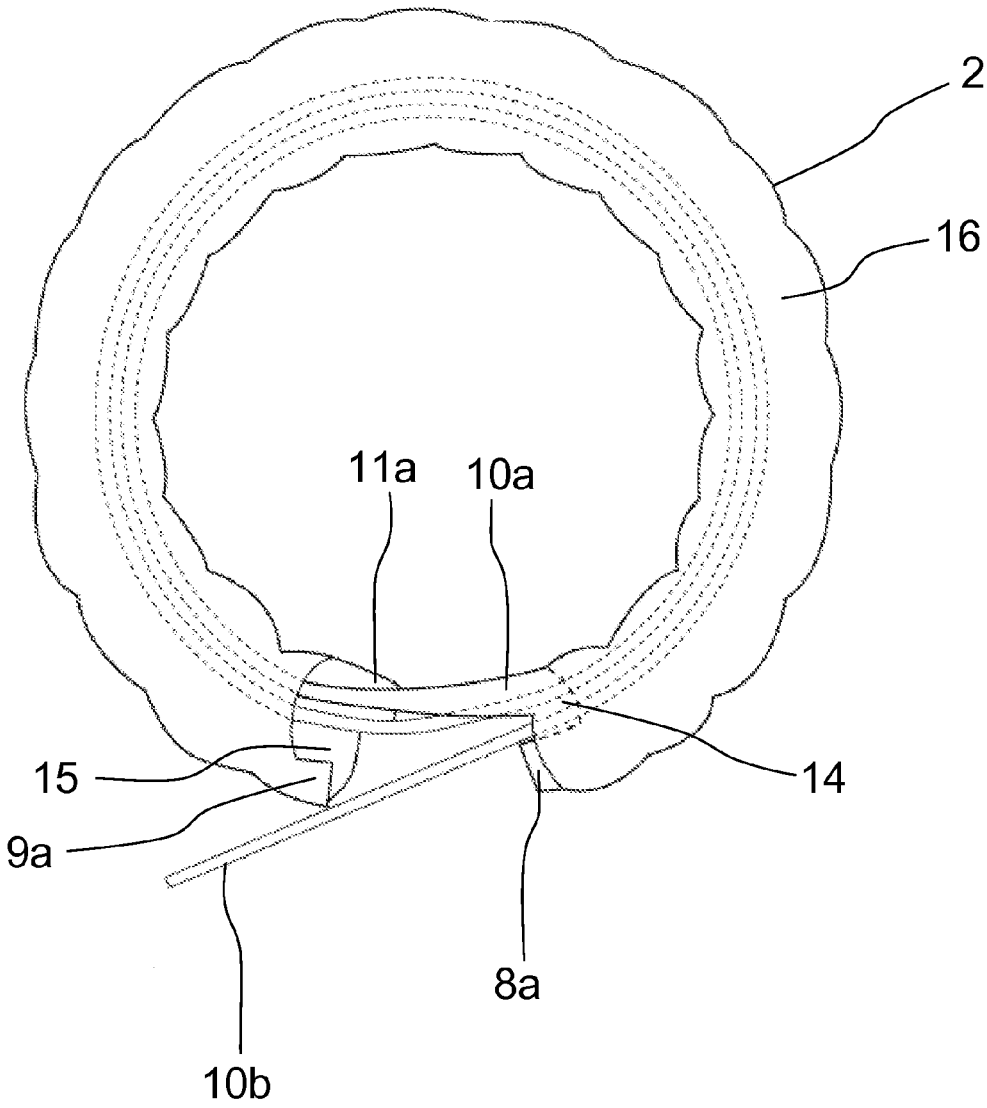
FIG. 14 is a schematic diagram of a loop with multiple passes of a bifurcation arm.

However, for a given body braid length, the loop diameter can be made larger by not pulling the bifurcation arms fully, leaving a portion of the bifurcation arms (8), (9), (10), (11) exposed (as shown in FIGS. 13 and 14) and not locking the bifurcation arm crotches against each other.

The high tensile strength comes at least in part from applying a tension load to the loop allowing the body braid (2) to collapse and tighten around the bifurcation arms (8), (9), (10), (11) increasing the normal force (in a direction that is normal to the longitudinal axis of the body braid). Since friction is equal to the coefficient of friction of two bodies multiplied by the normal force between them, the friction between the bifurcation arms (8), (9), (10), (11) and the inside of the body braid (2) is increased. This prevents the bifurcation arms from slipping, thus transferring the applied load to the bifurcation arms yielding a tensile strength multiplier to the loop. In addition, since the arms wrap around the loop the friction is also increased by the capstan effect as friction increases exponentially with the coefficient of friction and wrap angle ($T_2=T_1^{\mu\beta}$). The number of fiber ends passed through the core is a minimum of 2 times the number of fibers in the body braid itself. For example, if the body braid (2) is braided with 8 fibers, each bifurcation arm (8), (9), (10), (11) contains 4 fibers and, in some embodiments, as each of 4 bifurcation arms pass through the body braid inner core passageway (16) a single time the total number of fibers in the body braid inner core passageway (16) is sixteen, twice the number in the body braid (2) itself.

The number of passes through the body braid inner core passageway (16) is not limited to 1 for each bifurcation arm. FIG. 14 shows an example in which each arm makes two passes through the body braid inner core passageway (16). For clarity the bifurcation arms (8), (9), (11) are not shown. Bifurcation arm (10) starts at (10*a*), enters the body braid inner core passageway (16) at body braid inner core passageway opening (15) travels around the loop, exiting the body braid at body braid inner core passageway opening (14), re-enters the body braid inner core passageway (16) at body braid inner core passageway opening (15) and travels around the body braid inner core passageway (16) exiting the body braid at body braid inner core passageway opening (14) ending at (10*b*). As long as the bifurcation arms are long enough and the body braid inner core passageway (16) is large enough, any number of passes can be made with each pass adding two times the number of fibers in the body braid itself.

At step 1914 of FIG. 19, if the ends of the bifurcation arms (8), (9), (10), (11) are to be kept, step 1916 is executed. If the ends of the bifurcation arms (8), (9), (10), (11) are not to be kept, step 1918 is executed.

At step 1918 of FIG. 19, once the loop has been completed the bifurcation arms (8), (9), (10), (11) can be removed, resulting in the configuration shown in FIG. 1. This can be accomplished by shearing the fibers in the arm. Optionally, step 1920 is performed using a hot knife to cut and seal the ends of the bifurcation arms (8), (9), (10), (11) to eliminate unraveling. Tailless loops are useful in construction for lifting.

At step 1916, the ends of the bifurcation arms (8), (9), (10), (11) may be braided. In some applications such as suture anchoring, braided tails are useful for tying then the bifurcation arms (8), (9), (10), (11) can be left as is, FIG. 15 or, as in FIG. 16, they may be braided into a single 4-arm strand (17) for higher strength.

Figure 17:
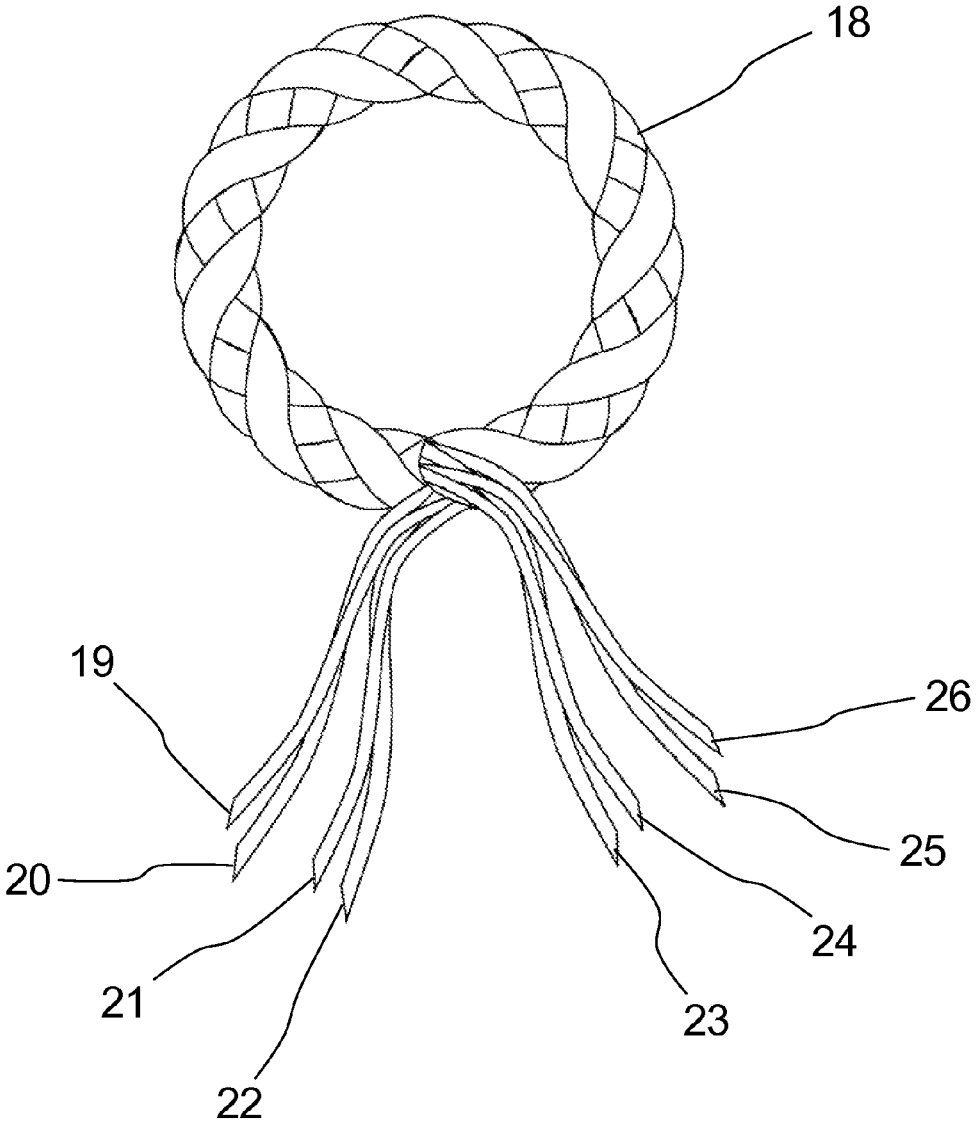
FIG. 17 is a schematic diagram of a loop formed with 8 bifurcation arms.
Figure 18:
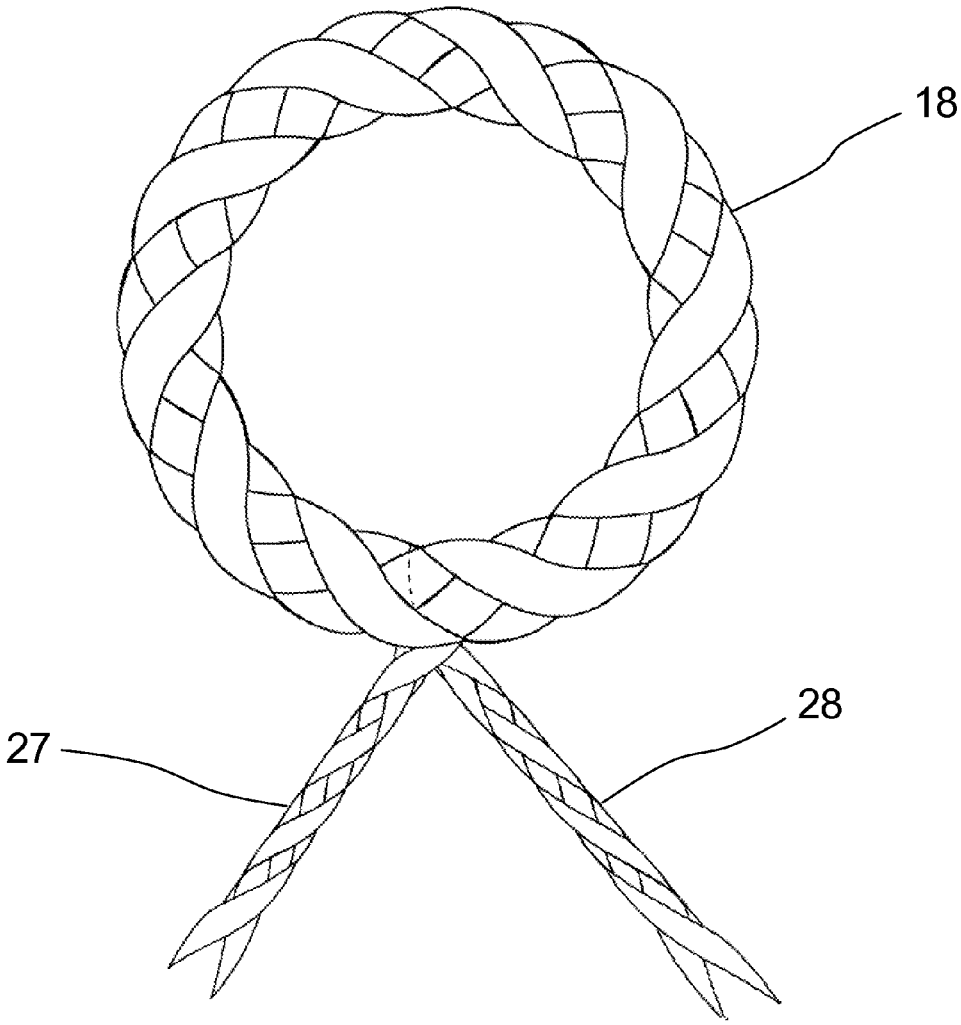
FIG. 18 is a schematic diagram of a loop with 2 integrated braided tails.

FIG. 17 shows by extension, but not limited to, the body braid (18) composed of 16 fibers and bifurcated into 4 bifurcation arms (19), (20), (21), (22) and (23), (24), (25), (26) at each end of the body braid (18), then after the loop has been formed the 8 bifurcation arms can be braided into 2 high strength 4-arm strands (27), (28), FIG. 18, or 1 higher strength 8-arm strand. This can be extended to as many fibers as desired for a particular application.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method, comprising:

(a) providing a braid unit having a body braid section, at least two first arms at a first end of the body braid section, and at least two second arms at a second end of the body braid section;

(b) passing each first arm in through the second end and out through the first end of the body braid section;

(c) passing each second arm in through the first end and out through the second end of the body braid section;

(d) pulling the first and second arms after steps (b) and (c), so as to gather the body braid section into a ring, wherein step (a) includes:

providing a bifurcated braid having continuously woven alternating tubular body braid sections and non-tubular arm sections; and cutting two successive ones of the non-tubular arm sections to form the braid unit.

2. A method, comprising:

(a) providing a braid unit having a body braid section, at least two first arms at a first end of the body braid section, and at least two second arms at a second end of the body braid section;

(b) passing each first arm in through the second end and out through the first end of the body braid section;

(c) passing each second arm in through the first end and out through the second end of the body braid section;

(d) pulling the first and second arms after steps (b) and (c), so as to gather the body braid section into a ring, further comprising:

bending each first arm around an outside of the body braid section before step (b); and bending each second arm around the outside of the body braid section before step (c).

3. The method of claim 2, further comprising, after steps (b) and (c) and before step (d), gathering together respective portions of each first and second arm outside of the body braid section.

4. The method of claim 3, further comprising, before step (d), initiating a bend in the body braid section.

5. The method of claim 4, wherein the bend is initiated by restraining a middle portion of the body braid section while pulling the first and second arms.

6. The method of claim 2, further comprising bending each first arm and each second arm around the outside of the body braid section after step (d);

passing each first arm in through the second end and out through the first end of the body braid section a second time; and passing each second arm in through the first end and out through the second end of the body braid section a second time.

7. A method, comprising:

(a) providing a braid unit having a body braid section, at least two first arms at a first end of the body braid section, and at least two second arms at a second end of the body braid section;

(b) passing each first arm in through the second end and out through the first end of the body braid section;

(c) passing each second arm in through the first end and out through the second end of the body braid section;

(d) pulling the first and second arms after steps (b) and (c), so as to gather the body braid section into a ring, and (e) after step (d), braiding together ends of the first and second arms.

8. The method of claim 2, further comprising, after step (d), severing and sealing ends of the first and second arms.

9. The method of claim 2, wherein steps (b) and (c) include drawing the first and second arms though the body braid section using at least one snare.

10. A braided loop, comprising:

a braid unit having a body braid section bent in a ring, at least two first arms at a first end of the body braid section, and at least two second arms at a second end of the body braid section;

each first arm passing in through the second end of the body braid section and out through the first end of the body braid section; and each second arm passing in through the first end of the body braid section and out through the second end of the body braid section, whereby the first and second arms are adjacent to each other inside the body braid section, wherein:

the body braid section is tubular and is continuously woven from a plurality of fibers or yarns, and the first and second arms are non-tubular sections on each end of the tubular body braid section, the arms being continuously woven from the same plurality of fibers or yarns.

11. The braided loop of claim 10, wherein the first and second ends of the body braid section meet each other, forming a closed tubular ring.

12. A braided loop, comprising:

a braid unit having a body braid section bent in a ring, at least two first arms at a first end of the body braid section, and at least two second arms at a second end of the body braid section;

each first arm passing in through the second end of the body braid section and out through the first end of the body braid section; and each second an passing in through the first end of the body braid section and out through the second end of the body braid section, whereby the first and second arms are adjacent to each other inside the body braid section, wherein the first and second ends of the body braid section are separated from each other by a positive non-zero distance.

13. A braided loop, comprising:

a braid unit having a body braid section bent in a ring, at least two first arms at a first end of the body braid section, and at least two second arms at a second end of the body braid section;

each first arm passing in through the second end of the body braid section and out through the first end of the body braid section; and each section arm passing in through the first end of the body braid section and out through the second end of the body braid section, whereby the first and second arms are adjacent to each other inside the body braid section, wherein ends of the first and second arms are braided together.

14. A braided loop, comprising:

a braid unit having a body braid section bent in a ring, at least two first arms at a first end of the body braid section, and at least two second arms at a second end of the body braid section;

each first arm passing in through the second end of the body braid section and out through the first end of the body braid section; and each second arm passing in through the first end of the body braid section and out through the second end of the body braid section, whereby the first and second arms are adjacent to each other inside the body braid section, wherein:

the braid unit has four first arms and four second arms, the ends of the four first arms are braided together, and the ends of the four second arms are braided together.

15. A braided loop, comprising:

a braid unit having a body braid section bent in a ring, at least two first arms at a first end of the body braid section, and at least two second arms at a second end of the body braid section;

each first arm passing in through the second end of the body braid section and out through the first end of the body braid section; and each second arm passing in through the first end of the body braid section and out through the second end of the body braid section, whereby the first and second arms are adjacent to each other inside the body braid section, wherein the braid unit is a plurality of continuous fibers or yarns, extending without break from a distal end of the first arms across the body braid section to a distal end of the second arms.

16. A braided loop, comprising:

a braid unit having a body braid section bent in a ring, at least two first arms at a first end of the body braid section, and at least two second arms at a second end of the body braid section;

each first arm passing in through the second end of the body braid section and out through the first end of the body braid section; and each second arm passing in through the first end of the body braid section and out through the second end of the body braid section, whereby the first and second arms are adjacent to each other inside the body braid section, wherein:

each first arm passes in through the second end of the body braid section and out through the first end of the body braid section at least twice; and each second arm passes in through the first end of the body braid section and out through the second end of the body braid section at least twice.

* * * * *

UNITED STATES PATENT AND TRADEMARK OFFICE

CERTIFICATE OF CORRECTION

PATENT NO. : 8,448,555 B2
APPLICATION NO. : 13/191017
DATED : May 28, 2013
INVENTOR(S) : Richard M. Dow et al.

It is certified that error appears in the above-identified patent and that said Letters Patent is hereby corrected as shown below:

In the Claims:

Claim 12, Column 9, Line 31 – delete "an" and insert -- arm --.

Claim 13, Column 9, Line 47 – delete "section" and insert -- second --.

Signed and Sealed this
Seventeenth Day of March, 2015

Michelle K. Lee

Michelle K. Lee
*Director of the United States Patent and Trademark Office*